United States Patent [19]

Tribolet

[11] 4,227,279

[45] Oct. 14, 1980

[54] DOUBLE INSULATED APPARATUS

[76] Inventor: Herbert Tribolet, 1250 N. Third St., Grand Junction, Colo. 81501

[21] Appl. No.: 25,244

[22] Filed: Mar. 29, 1979

[51] Int. Cl.[3] ..... A47L 11/30

[52] U.S. Cl. ..... 15/321; 15/339

[58] Field of Search ..... 15/321, 339; 310/43, 310/50, 89; 417/373

[56] References Cited

U.S. PATENT DOCUMENTS

| | | | |
|---|---|---|---|
| 3,476,960 | 11/1969 | Rees | 310/50 |
| 3,477,125 | 11/1969 | Schwartz | 310/50 X |
| 3,671,699 | 6/1972 | Matthews | 310/50 X |
| 3,685,843 | 8/1972 | Jacyno | 310/50 X |
| 3,829,722 | 8/1974 | Rosenthal, Jr. et al. | 310/50 |
| 3,875,436 | 4/1975 | MacFarland | 310/50 X |
| 3,896,521 | 7/1975 | Parise | 15/353 X |
| 4,153,968 | 5/1979 | Perkins | 15/321 |

*Primary Examiner*—Christopher K. Moore

[57] ABSTRACT

Double insulated, electrically energized liquid handling apparatus, usable without a separate ground line connection, e.g. a jet hot water extractor for dispensing and wet vacuum extraction recovery of rug and carpet cleaning liquids, including an electrically insulating container, e.g. of non-conductive material such as plastic, thereby providing a first exterior insulating barrier, which protectively contains a reservoir connected to a delivery pump adapted for connection in turn with an external applicator for pumping, preferably hot, liquid from the reservoir for application to a surface to be cleaned, an electrically isolated delivery motor, e.g. an open coil induction motor, including a rotatably mounted shaft operatively connected for driving the pump, preferably via a pump journal having a leakproof double seal bearing, and insulating mounting structure, e.g. of such non-conductive material, for maintaining the motor both in electrically isolating non-conductive operative relation to the shaft for rotation of the shaft and in electrically isolating non-conductive relation to the reservoir and pump, thereby providing a second interior insulating barrier, and further including an electrically insulated conductive power and return line circuit conduit for energizing the motor with a source of current without a separate ground line, for double insulated operation of the motor, preferably in conjunction with a vacuum extraction recovery tank on the container coupled with a vacuum creating assembly in the container, e.g. for recovery of dispensed liquid, similarly protectively arranged in electrically isolated non-conductive relation to one another and to the delivery motor.

31 Claims, 6 Drawing Figures

DOUBLE INSULATED APPARATUS

Figure 1:
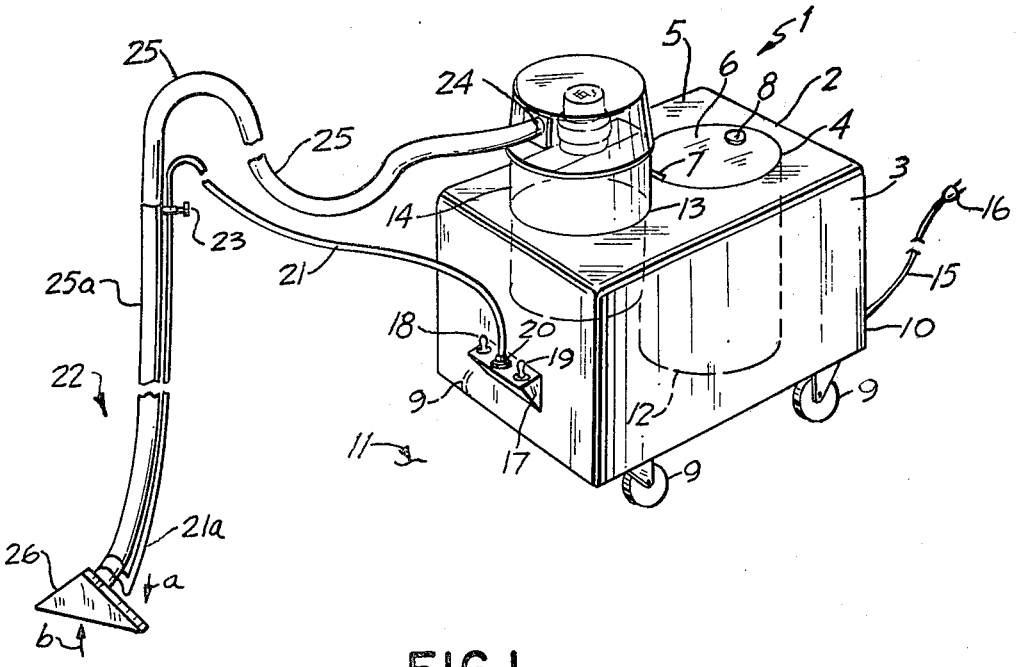

The present invention relates to a double insulated, electrically energized liquid handling apparatus, and more particularly to such an apparatus which is powered by ordinary household current yet which is usable without a separate ground line connection.

Electrically energized liquid handling apparatus of various types have been used heretofore, such as in the dispensing and wet vacuum extraction recovery of cleaning liquids for cleaning rugs, carpets or the like. These systems are sometimes referred to as jet hot water extractors. However, because of the conjoint presence of live current to operate the various pump motors, heating elements and the like, and water or other conductive cleaning liquid being handled thereby, a distinct danger constantly exists of shock to and even fatal electrocution of the user.

This danger may result from contact of the user with a part of the apparatus during operation which is wet and which is in accidental conductive connection with the live current, such as where the apparatus is of faulty design, or is in broken or worn or other malfunctioning condition. To avoid the perils of such operation, prudent practice and often governmental regulations dictate the inclusion in the liquid handling apparatus of a separate ground line connection as a safety measure.

Generally, such ground line or third line, in addition to the normal power and return lines, in an electrical cord serves to conduct any short circuiting power from the apparatus preferentially through the electrical cord to the appliance plug outlet ground connection rather than through the user to ground. Unfortunately, this limits proper use of such liquid handling apparatus only to those locations having appliance plug outlets already equipped with a three prong plug receiver connected to ground.

In the usual instance, the three line ground connection containing appliance cord is provided with a specially shaped or oriented three prong plug permitting its use solely with appliance plug outlets of corresponding mating prong shape or orientation. On the other hand, the electrical system of the appliance itself may be designed for operation only when a constant ground connection of some type is maintained and which automatically ceases to operate where the ground connection is interrupted.

Thus, in the latter case, even if the usual two prong plug were provided plus a separate third ground wire contact, e.g. formed as an associated floating wire, for independent attachment to a ground connection, the insertion of the two prongs in a normal appliance plug outlet would still be ineffective unless the third ground wire were also attached to a suitable ground connection.

The foregoing safety features, while understandably provided to prevent dangerous operation of an electrically energized liquid handling apparatus unless a ground line connection is also constantly maintained, as aforesaid, severely limit the use of such equipment. More specifically, many if not most homes and commercial establishments are only provided with electrical appliance plug outlets of the two prong variety and therefore cannot accommodate such liquid handling apparatus without special, often troublesome and expensive, permanent modification. On the other hand, temporary or makeshift modification would merely introduce further possibilities of inherent danger, considering the potential lethal effect of short circuited common household or commercial current, whether at 110 volts or 220 volts, in a wet environment.

It is among the objects and advantages of the present invention to overcome the drawbacks and deficiencies of known electrically energized liquid handling apparatus, and to provide a double insulated, electrically energized liquid handling apparatus or system, e.g. a jet hot water extractor for dispensing and wet vacuum extraction recovery of rug and carpet cleaning liquids, usable without a separate ground line connection, and having an electrically insulated conductive power and return line circuit conduit, or two prong plug equipped electrical cord, for energizing the electrical system thereof, e.g. a motor, with a source of ordinary or common household or commercial current, e.g. via the usual two prong plug receiving appliance outlet, without modification thereof and without a separate ground line, and more particularly having a motor operated liquid pumping system for dispensing, e.g. hot, cleaning liquid from a reservoir in the apparatus to the site to be cleaned, preferably in conjunction with a further motor operated vacuum system for wet vacuum extraction recovery in a tank on the apparatus of such liquid and entrained dirt, etc. from the site being cleaned.

It is among the further objects and advantages of the present invention to provide an apparatus of the foregoing type having an exteriorly and interiorly electrically isolated electrical system, including an electrically insulating container, e.g. of non-conductive material such as structural plastic, which thereby constitutes a first exterior insulating barrier and which protectively contains the electrically energized parts, and further including in the container a liquid reservoir flow connected to a delivery pump adapted for flow connection in turn with an external applicator for pumping liquid from the reservoir for application to such a surface to be cleaned, as well as an electrically isolated delivery motor, e.g. an open coil motor such as an induction motor, having a rotatably mounted shaft operatively connected for driving the pump, preferably via a pump journal equipped with a leakproof double seal ball bearing, and means for maintaining the motor both in electrically isolating non-conductive operative relation to the shaft for rotation of the shaft and in electrically isolating non-conductive relation to the reservoir and pump, which means thereby constitute a second interior insulating barrier, permitting double insulated operation of the motor safely energized by such power and return line conduit, or two prong plug equipped electrical cord, connected to a source of common household or commercial current without a separate ground line.

It is among the still further objects and advantages of the present invention to provide such an apparatus preferably with a dry and wet vacuum extraction recovery tank on the container flow connected with a vacuum creating assembly in the container arranged in electrically isolated non-conductive relation to the delivery motor and including a vacuum motor similarly protectively maintained and arranged in electrically isolated non-conductive relation to the other parts of the apparatus.

It is among the still further objects and advantages of the present invention to provide an apparatus of the foregoing type which may be produced at low cost and in an easy manner from readily available and readily assembled components, which is safe and durable in use, which is capable of rugged performance even under relatively severe abuse for long and reliable service, and in which all the electrically conductive and electrically operated motive and other parts are completely isolated electrically from the remainder of the parts of the apparatus and also are internally disposed in structurally and spatially remote protective disposition in the apparatus.

Figure 2:
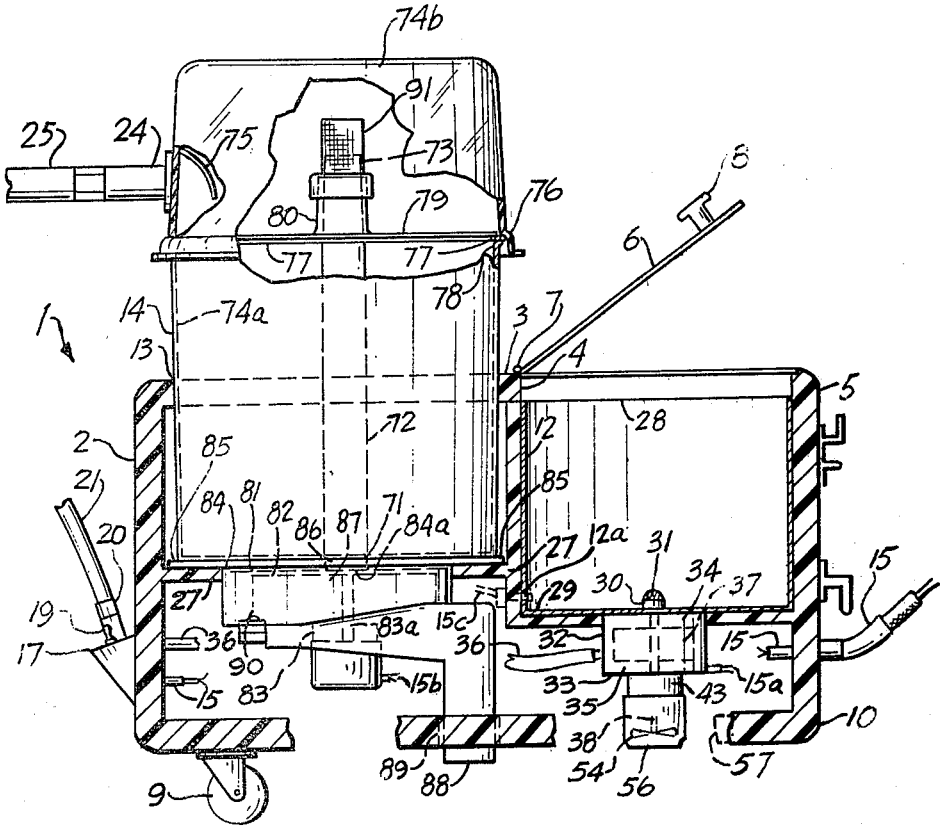
Figure 3:
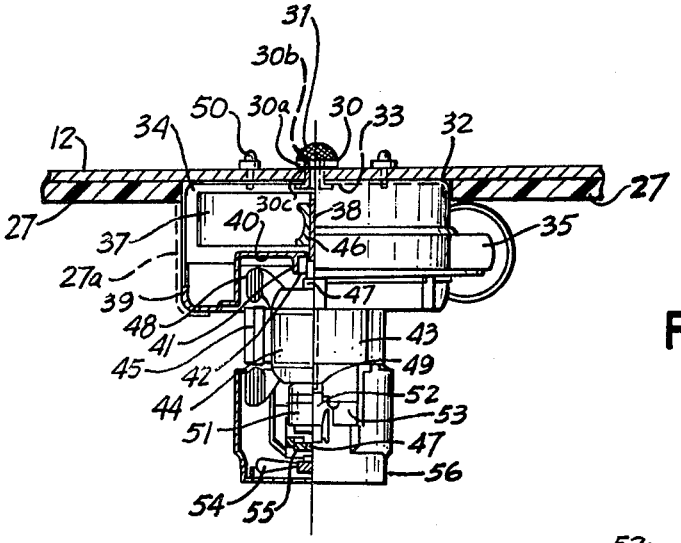
Figure 4:
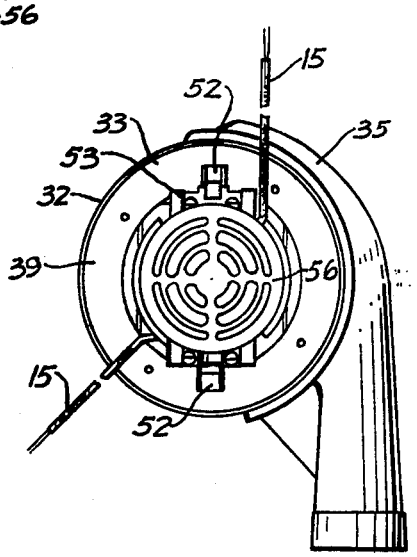
Figure 5:
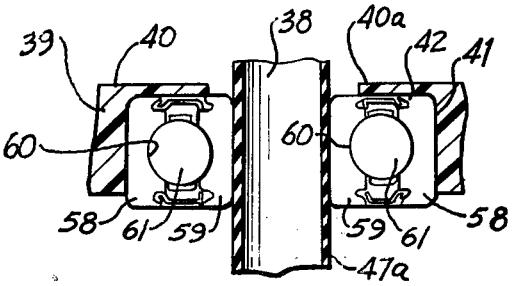
Figure 6:
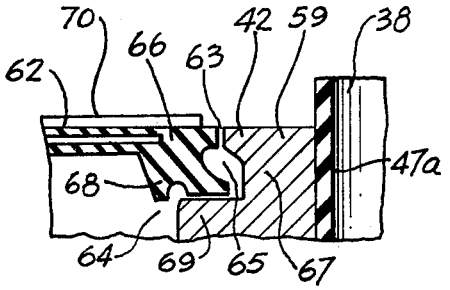

Other and further objects and advantages of the present invention will become apparent from a study of the within specification and accompanying drawings in which:

FIG. 1 is a schematic perspective view of an embodiment of the double insulated, electrically energized liquid handling apparatus of the invention, showing the disposition of certain elements thereof, FIG. 2 is a schematic partial sectional view of the apparatus of FIG. 1, showing the manner in which the related elements are operatively interposed in double insulated condition, FIG. 3 is a schematic enlarged partial sectional view of the liquid delivery pump and delivery motor therefor which are located within the container of FIG. 2, FIG. 4 is a schematic bottom view of the arrangement shown in FIG. 3, FIG. 5 is a schematic view of a portion of the leakproof double seal ball bearing through which the shaft of the delivery motor is journaled for operative connection with the delivery pump, in accordance with a preferred feature of the invention, and FIG. 6 is a schematic exaggerated view of a detail of the double seal bearing of FIG. 5.

Broadly, in accordance with the present invention a double insulated, electrically energized liquid handling apparatus is provided which is usable without a separate ground line connection. The apparatus contains an exteriorly and interiorly electrically isolated electrical system such as a motor which is energized with a source of common household or commercial current by an electrically insulated conductive power and return line circuit conduit means, or normal two prong plug equipped electrical cord, without a separate ground line.

All of the electrically conductive and electrically operated motive and other active parts are completely isolated electrically from the remainder of the parts of the apparatus and also are internally disposed in structurally and spatially remote protective disposition in the apparatus.

More particularly, the apparatus comprises an electrically insulating container, e.g. of non-conductive material such as structural plastic, thereby providing a first insulating barrier.

The container protectively contains therein a liquid reservoir flow connected to a delivery pump adapted for flow connection in turn with an external means of given appropriate utility, such as a conventional external applicator, for pumping liquid from the reservoir thereto, e.g. preferably hot cleaning liquid for application by the external applicator to a surface such as a rug or carpet to be cleaned.

The container also protectively contains therein an electrically isolated delivery motor including a rotatably mounted shaft operatively connected for driving the pump.

The container further contains therein means, such as electrically insulating mounting means, e.g. of non-conductive material such as plastic, for maintaining the motor both in electrically isolating non-conductive operative relation to the shaft for rotation of the shaft and in electrically isolating non-conductive relation to the reservoir and pump, thereby providing a second insulating barrier.

The delivery motor may desirably take the form of an open coil motor, such as an open coil induction motor, having armature rotor means operatively connected for rotating the shaft which drives the pump and field coil stator means operatively arranged in spaced relation to the shaft for rotation of the rotor means. In this regard, correspondingly electrically insulating mounting means may be used for maintaining the rotor means and stator means in electrically isolating non-conductive operative relation with respect to the shaft for appropriate rotation of the shaft and also for maintaining the rotor means and stator means in electrically isolating non-conductive relation to the reservoir and pump, whereby to provide the second insulating barrier.

Accordingly, the electrically insulated conductive power and return line circuit means may be conveniently protectively arranged in the container for energizing the motor with a source of common or ordinary household or commercial current, e.g. at 110 volts or 220 volts, as the case may be, without a separate ground line, for double insulated operation of the motor in the container for driving the pump by the shaft.

In accordance with a preferred feature of the invention, the shaft is operatively connected to the pump through a substantially leakproof double seal ball bearing for journaling the shaft to the pump in substantially leakproof double seal condition. Such a double seal bearing in accordance with present day developments may be provided with an outer concentric axially extending metal ring for seating in a journal opening in the pump housing and an inner concentric axially extending metal ring for seating on the shaft, with the rings providing an enclosed race therebetween, doubled sealed at each axial end and containing ball bearings or the like packed in grease.

In accordance with a further preferred feature of the invention, a substantially airtight dry or wet vacuum extraction recovery tank is also provided on the container. The tank conveniently includes a tank inlet means adapted for flow connection with an external conventional vacuum hose, a tank flow opening and an internal riser tube positioned in the tank and arranged for flow communicating the interior of the tank with the tank flow opening. In conjunction therewith, means for creating a vacuum are positioned in the container in flow connection with the tank flow opening, for permitting vacuum extraction recovery through such external vacuum hose of dry or wet ingredients, such as used cleaning liquid dispensed by the liquid pump from the reservoir to the external applicator and thence to a cleaning site or surface such as a rug or carpet, thereafter to be drawn back into the tank.

Of course, in order to maintain the desired electrical insulation protective condition in the apparatus, the tank and means for creating a vacuum are also arranged in electrically isolating non-conductive relation to the delivery motor. The means for creating a vacuum may suitably include a vacuum pump and an electrically energized vacuum motor protectively contained in the container.

Accordingly, further means such as electrically insulating mounting means, e.g. of non-conductive material, are similarly provided for maintaining the vacuum pump in electrically isolating non-conductive relation to the delivery motor and for maintaining the vacuum motor in electrically non-conductive relation to the reservoir, delivery pump, shaft, delivery motor, vacuum tank and vacuum pump.

In this regard, the power and return line circuit conduit means are suitably arranged for selectively electrically energizing the vacuum motor as well, likewise without a separate ground line.

With respect to one preferred embodiment of the invention, a double insulated, electrically energized cleaning liquid handling apparatus, usable without a ground line connection, is contemplated comprising an electrically insulating, externally protectively enclosing and outwardly confining container of non-conductive material, thereby providing a first exterior insulating barrier, a cleaning liquid dispensing reservoir in the container, a liquid delivery pump in the container including a pump housing having an intake portion flow connected to the reservoir and a delivery portion adapted for flow connection in turn with an external applicator for applying dispensed cleaning liquid to a surface to be cleaned, and liquid pumping means operatively mounted in the pump housing and adapted to be driven by a rotatable shaft for pumping cleaning liquid from the intake portion to the delivery portion of the pump housing, as well as an electrically isolated delivery induction motor in the container.

Such induction motor suitably includes a rotatably mounted shaft operatively connected, as aforesaid, for driving the pumping means, electrically insulating rotor mounting means of non-conductive material, an induction armature rotor operatively mounted by the rotor mounting means on the shaft for common rotation with the shaft and arranged thereon in electrically isolating non-conductive relation with respect thereto, electrically insulating stator mounting means of non-conductive material, and an electrically energizable field coil stator radially spaced from the shaft and rotor and stationarily mounted by the stator mounting means in the container for induction rotation of the rotor and arranged thereat in electrically isolating non-conductive relation to the shaft, thereby providing a second interior insulating barrier.

Also correspondingly contemplated therewith are electrically insulated conductive power and return line circuit conduit means for energizing the delivery motor with a source of common household or commercial current without a separate ground line, for double insulated operation of the motor, as noted above.

As regards certain further appropriate features of the invention, the container may be composed of any suitable plastic, e.g. of sufficient structural and dielectrical integrity to provide a non-conductive supporting framework for protectively carrying therein and thereon the various elements of the apparatus.

Moreover, the rotor mounting means may be fashioned in the form of a sleeve of non-conductive material such as plastic or other suitable electrically inert material, e.g. similarly of sufficient structural and dielectrical integrity as desired, with the sleeve operatively interposed between and interconnecting the motor shaft and rotor for common rotation.

The stator mounting means is preferably located on the pump housing itself. In this regard, the pump housing may include desirably a wall portion of non-conductive material, e.g. of the foregoing suitable type, and the stator mounting means may be simply mounted on such pump wall portion.

With respect to the operative connection of the motor shaft to the pumping means, the pump housing may be provided advantageously with a journal opening defined in such pump wall portion in which the substantially leakproof double seal bearing is situated. Hence, one end of the shaft may extend through the opening thereat for such operative connection and be journaled in the bearing in substantially leakproof double seal condition.

Since the adjacent pump wall portion is composed of such non-conductive material and the stator is radially spaced from the shaft, the shaft will be maintained effectively in electrically isolating non-conductive relation with respect to stator. In the same way, since the rotor mounting sleeve is likewise composed of non-conductive material, the shaft will also be maintained effectively in electrically isolating non-conductive relation with respect to the rotor carried thereon for common rotation therewith.

Preferably, the other or opposite end of the shaft carries a cooling fan thereon for common rotation therewith as well, for directing ambient air into flushing and cooling contact with the delivery motor and pump so as to cool the stator and rotor as well as the pump parts during operation thereof.

In this regard, such other end of the shaft may also be remotely journaled in a further bearing in the container arranged in electrically isolating non-conductive relation with respect to the stator and rotor, and an electrically non-conductive protective cage may be desirably provided in covering relation over the other end of the shaft and the fan.

For this purpose, remote journal mounting means of like non-conductive material may be attached to the stator, i.e. for positioning the further bearing in which the other end of the shaft is remotely journaled and for attaching the protective cage in protective disposition over such shaft end and fan.

In accordance with a particularly suitable feature of the invention, the motor shaft extends substantially vertically downwardly from the journal opening in the pump housing and the double seal bearing is disposed in the journal opening in substantially liquid tight leakproof friction fit stationary relation therewith for maintaining the shaft in axially stationary and rotatably mounted suspended relation with respect to the pump wall portion thereat. In this regard, the stator is also attached to such pump wall portion in radially spaced relation to the shaft and is situated in corresponding downwardly depending disposition and carries the remote journal mounting means such that the latter extends therebelow. Thus, the fan conveniently directs the flushing and cooling air upwardly into contact with the delivery motor and pump parts.

The delivery motor may be effectively constituted as an open coil induction motor of the type contemplating the inclusion of commutator means. Such commutator means may be operatively mounted on the shaft for common rotation therewith by electrically insulating commutator mounting means, similarly of non-conductive material, and preferably in the form of an extension of the rotor mounting sleeve or a separate further sleeve, as desired. The commutator means are suitably provided in appropriate electrical operative connection with the armature rotor and yet remain in electrically isolating non-conductive relation to the shaft.

In conjunction therewith, brush means may be operatively mounted on the remote journal mounting means adjacent to the stator and arranged thereat in appropriate electrical connection with the stator yet in electrically isolating non-conductive relation to the shaft for electrically conductive coacting sliding contact with the commutator means in the usual manner.

With respect to another significant feature of the invention, the delivery pump may be directly connected to the reservoir, e.g. at the exit opening at the bottom portion thereof, and be arranged in substantially downwardly suspended relation thereto, advantageously with the reservoir being provided as a built-in reservoir within the container and serving essentially as the sole direct support for the substantially downwardly suspended delivery pump, delivery motor and other related parts connected thereto.

With respect to the preferred inclusion of the dry or wet vacuum extraction recovery system with the liquid dispensing system of the invention, selective switch means may be advantageously provided in the power and return line circuit conduit means for selectively energizing the delivery motor alone, the vacuum motor alone, or both motors together.

The vacuum pump may suitably include fluid pumping means adapted to be driven by a rotatable further shaft, and accordingly the vacuum motor may be desirably provided as a further induction motor, e.g. corresponding to that for driving the delivery pump, having a further shaft operatively connected for driving such fluid pumping means.

Conveniently, the vacuum recovery tank is removably positioned on the container for receiving dry as well as wet ingredients delivered through the tank inlet means for periodic emptying.

The tank riser tube may be preferably provided with a porous filter element to prevent various dry and wet ingredients, including dust, dirt and other soil debris, delivered into the tank, from flowing through the riser tube and out the tank flow opening to the vacuum creating means.

Also, a deflector means may be preferably provided in the interior of the tank to deflect dry and wet ingredients delivered through the tank inlet means into the tank away from the immediate vicinity of the entrance to the riser tube which is located at the riser end portion thereof disposed in the tank. This will similarly prevent flow of such ingredients through the riser tube entrance and into and through the riser tube and out of the flow opening to the vacuum creating means.

Referring to the drawings, and initially to FIG. 1, a double insulated, electrically energized cleaning liquid handling apparatus 1 is shown, which is usable without a separate ground line connection. Apparatus 1 which may take the form of a jet hot water extractor, includes a self-contained transportable electrically insulating, externally protectively enclosing and outwardly confining structural plastic container 2, for example composed of conventional ABS plastic, e.g. high impact fire retardant ABS material. Container 2 is in any case composed of material of suitable structural and dielectrical integrity sufficient to provide an electrically non-conductive supporting exterior and interior framework for protectively carrying therein and thereon in electrically isolated condition the various operative elements of the system of apparatus.

Container 2 has an outer confining electrically non-conductive or insulating wall surface 3, e.g. of such plastic, provided with a reservoir access opening 4 in the upper portion 5 thereof and an openable electrically non-conductive or insulating closure means or cover 6, e.g. of like plastic, preferably suitably mounted by means of a hinge 7 to the container portion thereat for pivotal opening and closing of the opening 4 via handle 8. Hence, cover 6 in closed position forms a portion of the outer non-conductive wall surface 3 thereat.

In this way, container 2 by its very nature and construction provides a first or primary exterior insulating barrier for safely protecting the user from accidental electrical shock.

Of course, hinge 7 may be omitted and cover 6 may be merely laid in removable resting contact with a recessed rim portion at the periphery of access opening 4 (not shown) or the like, as the artisan will appreciate.

Roller means such as four caster type rollers 9 or the like are pivotally secured in conventional manner to the underside of the lower portion 10 of container 2 for facilitating transporting movement or travel of the container along a support surface 11, e.g. a rug or carpet to be cleaned.

A cleaning liquid dispensing reservoir 12 is favorably protectively disposed completely within container 2 at the location of the access opening 4. The container wall surface 3 is also provided with a separate tank insertion opening 13 in upper portion 5, suitably spaced from access opening 4, for removable insertion at least partially thereinto of the emptiable substantially air tight dry and wet vacuum extraction recovery tank 14.

Electrically insulated conductive power (hot) and return (neutral) line circuit conduit means, including the usual cord 15 and two prong household socket plug 16, are provided on the container 2 for connecting the electrical system of the apparatus to a source of common household or commercial current, e.g. 110 volt or 220 volt appliance socket, as the case may be, without a separate ground line.

Means (not shown in FIG. 1) within container 2 provide a second or secondary interior insulating barrier for safely protecting the user from accidental electrical shock.

End panel 17, suitably positioned on the container wall surface 3, and preferably constructed of like plastic, is provided with appropriately electrically insulated individual manual on-off switches 18 and 19 for controlling operation of the liquid dispensing and vacuum recovery electrical systems located within container 2.

Panel 17 also has a, preferably appropriately electrically insulated, feed snap coupler 20 of conventional type for quick releasable attachment of an external delivery flow line 21, e.g. of flexible plastic, for delivery cleaning liquid from reservoir 12 to the external applicator 22, for selectively applying via rigidly mounted adjustable flow control valve 23 thereon such dispensed cleaning liquid to the surface 11 to be cleaned.

This is accomplished in conventional manner through a series of radially outwardly diverging spray openings (not shown) at the terminal portion of applicator flow line 21*a*, e.g. of flexible plastic, to which line 21 is connected, and in the direction generally indicated by arrow a.

In turn, tank 14 is provided with a tank inlet means, e.g. in the form of a return snap coupler 24 of conventional type, for quick releasable attachment of an external vacuum hose 25, e.g. of flexible plastic, for dry and wet vacuum extraction recovery of ingredients from the surface 11 via rigid suction tool 26, e.g. preferably of metal such as stainless steel or plastic, in the usual manner at the terminal portion of the rigid applicator 25*a* to which hose 25 is connected, and in the direction generally indicated by arrow b.

The terminal end of flow line 21*a* may be suitably fixedly positioned on the lower end of rigid hose 25*a* adjacent to suction tool 26 and the initial or upper end thereof may be fastened to the upper end of such hose 25*a* via valve 23 rigidly mounted thereat. Hose 25*a* is also preferably formed of metal such as stainless steel or plastic, i.e. rigid or structural plastic, so as in effect to constitute an inflexible hose.

Applicator 22 therefore desirably constitutes a rigid or stiff wand comprising hose 25*a* and a flexible plastic flow line comprising line 21*a* interconnected at the upper end or handle portion thereof at valve 23 and at the lower end or floor engaging portion thereof adjacent suction tool 26 for common movement in the usual way along the rug, carpet or other surface to be cleaned.

As may be seen more clearly in FIG. 2, reservoir 12 is preferably permanently fixed within container 2 on internal supporting framework 27 of non-conductive material, e.g. composed of like plastic, and thus is completely disposed inside the silhouette of the apparatus as a built in element. Reservoir 12 has an open upper portion 28 communicating with the exterior of the container through access opening 4 and normally closed off by cover 6, which prevents spillage as the apparatus is moved about, and also has a closed lower portion 29 provided with a dispensing exit 30.

A strainer screen 31 may be suitably disposed over exit 30 to prevent foreign material particles from passing outwardly therethrough.

Reservoir 12 may be made of any suitable material, preferably inert to detergents and the like, such as stainless steel or structural plastic as desired. Since it is protectively disposed within container 2 and held in place by the more or less surrounding adjacent portion of framework 27 under cover 6 in suitably spaced relation to the other elements of the apparatus, the fact that reservoir 12 may be formed of conductive metal is not critical.

Protectively insulated electrically energized heating means 12*a*, in an enclosed housing, e.g. a cal-rod type indirect heater, may be optionally provided at reservoir 12 in conventional manner yet remote from the other parts for preheating the cleaning liquid, e.g. detergent solution, if desired, with an appropriate further control switch (not shown) being located on panel 17 for its operation similar to switches, 18 and 19. Alternatively, preheated or hot liquid may simply be added to reservoir 12 from an extraneous source.

A liquid delivery pump 32 is also protectively disposed completely within container 2 below reservoir 12. Pump 32 includes pump housing 33 having an intake portion 34 flow connected to reservoir dispensing exit 30 and a delivery portion 35 flow connected to a liquid delivery flow conduit 36.

Flow conduit 36 is preferably formed of plastic, especially flexible plastic, at least at its remote or distal end portion, and outwardly terminates at panel 17 to provide an electrically insulating connection portion of non-conductive material extending to the outer wall surface 3 thereat for flow connection at such remote or distal portion via feed coupler 20 with external delivery line 21 and applicator 22. Thus, cleaning liquid, e.g. soapy water, detergent solution, etc., dispensed from reservoir 12 by pump 32 may be selectively applied through conventional adjustable control valve 23 to the surface to be cleaned using external applicator 22.

Delivery pump 32 also includes liquid pumping means, which may take the form of a rotary impeller 37, operatively mounted in pump housing 33 and adapted to be driven by a substantially vertical rotatable shaft 38. In this manner, cleaning liquid from reservoir 12 may be efficiently pumped from the intake portion 34 to the delivery portion 35 of pump housing 33 and thence through flow conduit 36 to the external applicator 22.

As shown more clearly in FIGS. 3 and 4, at least the lowermost portion 39 of pump housing 33 is formed of non-conductive material, such as electrically insulating structural plastic, and includes a non-conductive wall portion 40 having a journal opening 41 therein provided with a bearing 42, preferably constituted as a substantially leakproof double seal ball bearing (FIGS. 5 and 6). An electrically isolated delivery motor 43, such as in the form of an open coil induction motor, is protectively disposed completely within container 2 below pump 32. Delivery motor 43 includes generally shaft 38 plus an armature rotor 44 and a field coil stator 45.

More specifically, shaft 38 advantageously constitutes a downwardly extending substantially vertical rotatably mounted shaft having its upper end extending upwardly through journal opening 41 and journaled in the double seal bearing 42 in substantially leakproof condition thereat. The upper end of shaft 38 is operatively connected to pump impeller 37 for driving the same, preferably by friction fit stationary engagement with the appropriately sized usual central aperture or well in hub 46 of the impeller.

As to the electrical components of delivery motor 43, armature rotor 44 is suitably provided as an annular induction armature rotor stationarily mounted on shaft 38 for common rotation therewith and provided with an electrically insulating rotor mounting sleeve 47 of non-conductive material, such as conventional structural insulation material of the usual inorganic inert type, structural plastic of the stated type, or the like, as desired. Sleeve 47 is advantageously operatively interposed between and fixedly interconnects the rotor 44 and shaft 38 for such common rotation, and is appropriately arranged for maintaining the rotor in electrically isolating non-conductive relation to the shaft.

Preferably, sleeve 47 extends along the full medial axial length of shaft 38 intermediate the portions at the upper and lower ends of the shaft and is sized with respect to the outer diameter of shaft 38 and the inner diameter of annular armature rotor 44 for appropriate friction fit or tight press fit stationary engagement therewith.

In conjunction therewith, the field coil stator 45 is suitably provided as an electrically energizable induction motor stator having suitable open field coils or windings 48 arranged in conventional manner and connected via switch 18 on panel 17 to the appropriate power and return line leads in cord 15. Field coil stator 45 is radially spaced from shaft 38 and armature rotor 44 in the usual way. More especially, stator 45 is also radially spaced from journal opening 41 and double seal bearing 42.

Pursuant to a significant feature of the invention, stator 45 is advantageously stationarily mounted on the lowermost portion 39 of pump housing 33 at the non-conductive wall portion 40 adjacent thereto by screws 49 or the like upwardly engaging the non-conductive portion of the housing thereat. Thus, stator 45 is downwardly suspended from the pump 32 in electrically isolating non-conductive relation thereto, and pump 32 in turn is fixedly connected to reservoir 12 and arranged in downwardly suspended relation to the reservoir and the surrounding non-conductive internal framework 27 adjacent thereto.

Such suspended connection of pump 32 to reservoir 12 may be achieved, as the case may be, via a screw connection coupling at exit 30, and/or via a friction fit with the surrounding framework 27, desirably together with mounting brackets 27*a*, embracing the periphery of pump housing 33 thereat, and/or via a direct leak-proof attachment between the bottom wall of reservoir 12 and the top wall of pump housing 33, e.g. by screws, bolts or the like having suitable sealing washers, as shown at 50.

More specifically, as regards the screw connection coupling at exit 30, which is the preferred manner of suspended connection, this may be achieved by screwing the nut 30*a* onto the externally threaded intake snout 30*b* which is preferably rigidly fixed to the upper central opening in intake portion 34 of pump housing 33, to bring the flat upper side of pump housing 33 into self-supporting surface engagement with the central underside of reservoir 12 thereat under the sealing influence of sealing washer 30*c* of rubber or the like. Hence, the pump 32 desirably may be designed to be attached via a nut and seal directly to the reservoir as the sole support thereof and without the need for other or special fittings or attachments.

Although the exact manner of attachment of the various coacting elements in the liquid dispensing system is not critical, the form selected will understandably be sufficient for stationarily rigidly supporting in container 2, essentially through the interior framework 27, both the delivery pump 32 and delivery motor 43 for dynamic operation and at the same time for maintaining the electrically conductive components of the motor in electrically isolated non-conductive condition with respect to the remaining parts of the system in the apparatus.

In connection with the use of motor 43 as an open coil induction motor, rotatable commutator means such as in the form of an annular commutator 51 of the usual type may be provided in conjunction with stationarily positioned or non-rotative brush means such as in the form of a pair of diametrically opposed and spaced apart resiliently mounted, e.g. spring urged, brushes 52.

Annular commutator 51 is operatively mounted on shaft 38 vertically below and spaced from armature rotor 44 for common rotation with the shaft. Commutator 51 is maintained in electrical connection with the armature of rotor 44 by suitable leads (not shown) in conventional manner and in electrically isolating non-conductive relation to shaft 38 by the presence of electrically insulating commutator mounting means of non-conductive material thereat, preferably constituted by the extended portion of sleeve 47 situated on shaft 38 below armature rotor 44.

On the other hand, brushes 52 are operatively mounted on stationarily rigidly positioned remote journal mounting means such as in the form of remote journal bracket 53. Remote bracket 53 is downwardly suspended from field coil stator 45 and is formed of non-conductive material such as structural plastic of the foregoing type. More specifically, screws 49 actually extend through both remote bracket 53 and field coil stator 45 for attaching these elements fixedly to the non-conductive wall portion 40 of pump housing 33.

In this way, opposed brushes 52 may be non-rotatively radially positioned on non-conductive remote bracket 53 adjacent to stator 45 and maintained in electrical connection with the open field coils 48 of the stator by suitable leads (not shown) in the conventional manner and in electrically isolating non-conductive relation to shaft 38 due to the radial spacing thereof from the shaft and the intervening presence of the extended portion of non-conductive sleeve 47. Nevertheless, due to the radially resilient mounting of the brushes 52 on remote bracket 53 by means of appropriate springs (not shown), such opposed brushes are arranged for electrically conductive coacting sliding contact in the usual way with the commutator 51 in axial alignment therewith on sleeve 47 and generally in radially inward disposition thereto.

Hence, in conventional manner, current is supplied via cord 15 to the motor 43 for energizing the field coils 48 of stator 45 and is controlled by brushes 52 and commutator 51 for actuating the armature of rotor 44. The electrically insulated conductive power and return line circuit conduit means constituted by cord 15 thereby electrically energizes the thus electrically isolated delivery motor 43 with a source of common household or commercial current without a separate ground line, for double insulated operation of such motor within the container for driving the pumping means impeller 37 by the shaft 38.

Specifically, since the stator 45 is radially spaced from the journal opening 41, double seal bearing 42, shaft 38 and rotor 44 and is stationarily mounted on the pump housing non-conductive wall portion 40 adjacent thereto via opposed screws 49, such stator is suitably arranged for induction rotation of the rotor while being positioned thereat in electrically isolating non-conductive relation with respect to reservoir 12, the interior of pump housing 33, pumping means impeller 37, journal opening 41, double seal bearing 42 and shaft 38, yet in operative electrical connection with the brushes 52 on non-conductive remote bracket 53, and in turn with commutator 51 and rotor 44, which latter two electrical elements are themselves disposed via sleeve 47 in non-conductive relation to shaft 38 while being mounted thereon for common rotation therewith.

In essence, the non-conductive pump housing wall portion 40 and sleeve 47 together with the radially spaced disposition of stator 45 with respect to shaft 38 thereby provide a second interior insulating barrier, separate and apart from the first exterior insulating barrier constituted by the container 2 itself and the appropriate supplemental portion provided by the internal framework 27 thereof. Insofar as the brushes 52 are concerned, the non-conductive remote bracket 53 similarly provides a supplemental portion of such second interior insulating barrier in relation to the commutator 51 as disposed on such sleeve 47.

With respect to a particularly advantageous feature of the present invention, the lower end of shaft 38 is provided with a fan 54, carried for common rotation therewith for upwardly directing ambient air into flushing contact with delivery motor 43 and pump 52 to cool the stator, rotor, shaft, bearing and other related parts during operation thereof.

Preferably, the lower end portion of shaft 38, e.g. axially medially or inwardly of fan 54, is conveniently remotely journaled in a further bearing 55 mounted in non-conductive remote bracket 53 and thus arranged in electrically isolating non-conductive relation with respect to stator 45 and rotor 44. Bearing 55 may be a simple ball bearing or a double seal ball bearing like bearing 42, if desired.

Advantageously, an electrically non-conductive protective cage 56, e.g. of like structural plastic, is provided in covering relation over the lower end of shaft 38 and the fan 54. Cage 56 may be conveniently removably attached by any suitable means such as screws to the remote bracket 53 more or less radially outwardly of the contact portions of the opposed brushes 52. This insures the integrity of the protective electrical isolation of the electrically energized parts disposed thereabove in the container 2.

A hidden ambient air flow opening 57 (FIG. 2), preferably protected by a covering screen (not shown), may be desirably provided in the bottom wall portion of container 2 in the vicinity of cage 56 for enhanced exchange of ambient air between the exterior of the container and the interior portion thereof adjacent the cage and fan.

The interface between the adjacent exterior of shaft 38 and the interior of the further bearing 55 in remote bracket 53 may be advantageously provided in any appropriate manner with an intervening annular axially extending layer or sleeve (not shown) of non-conductive material such as plastic for added electrical isolation between such parts, and the same type layer or sleeve (not shown) may be provided likewise between the interior of the mounting hub of the fan 54 and the adjacent exterior of shaft 38 for like purposes. In fact, if desired, a similar layer or sleeve 47*a* (FIG. 5) may be optionally provided between the interior of the double seal bearing 42 and the adjacent exterior of shaft 38 thereat.

As the artisan will appreciate, the various electrically isolating layers or sleeves may be spaced apart or integral with one another along the axial extent of the shaft 38. In particular, the shaft may be suitably provided with a continuous sleeve, e.g. a friction fit non-slip sleeve, more or less from one end to the other, if desired, to accommodate each of the parts mounted thereon for rotation therewith and the journaling of the shaft in the bearings in which such shaft rotates, all in proper electrically isolating non-conductive relation.

Hence, shaft 38 is desirably electrically isolated from all other structural parts of the apparatus just as the field coils 48, stator 45, brushes 52, rotor 44 and commutator 51 are so isolated. Even if leakage of liquid were to occur, e.g. downward dripping from pump 32, the depending disposition of these parts in non-conductive and/or spaced relation to pump 32 and the remainder of the parts in container 2 would minimize any danger of shock to the user potentially causable thereby.

FIG. 5 shows in exaggerated form the positioning of the leakproof double seal ball bearing 42 in journal opening 41 of non-conductive wall portion 40 of the lowermost portion 39 of pump housing 33. An optional radially inward extension 40*a* forming a ring or well with journal opening 41 may be provided to act as a protective stop such as when upwardly press fitting the bearing 42 in place in journal opening 41.

Bearing 42 (e.g. Nippon Seiko Kabushiki Kaisha, type DDU), preferably includes an outer concentric axially extending metal ring 58 and an inner concentric axially extending metal ring 59 defining a common annular enclosed race 60 therebetween containing ball bearings 61 or the like packed in grease or other suitable permanent or long lasting lubricant (not shown).

Outer bearing ring 58 is seated, e.g. in tight friction fit, in surrounding journal opening 41 in pump housing 33 and inner bearing ring 59 is seated, e.g. similarly in tight friction fit, on shaft 38, preferably or optionally with non-conductive sleeve 47*a* interposed operatively therebetween to enhance the electrical isolation relationship of the various parts. Such positioning is sufficient in conjunction with the remote further bearing 55 for effective operation of the shaft 38 for driving the impeller 37 of the pump 32 substantially without noise or vibration.

As indicated more clearly in FIG. 6, an internally metal-reinforced washer-like annular rubber or plastic seal or the like 62 is stationarily provided on outer ring 58. One such seal 62 is actually provided at each axial end of the bearing structure, i.e. on each axial end of outer ring 58, thereby constituting a separate sealing structure at each axial end of the bearing. The sealing mechanism at each such axial end of the bearing in this regard is fashioned as a pair of narrow gaps or lips 63 and 64.

Gap 63 is constituted as an axially outer lip or narrow gap which holds grease (not shown) in an adjacent annular space 65 defined between the enlarged internal periphery 66 of the corresponding annular seal 62 and the adjacent external periphery 67 at the axial end of the inner ring 59 thereat. Gap 64 is constituted as an axially inner double contact lip or seal lip between an axially inwardly or medially extending skirt 68 at the internal periphery 66 of such annular seal 62 and an internal corner shoulder 69 thereat on the external periphery 67 at such axial end of the inner ring 59.

In this manner, the inner contact lip 64 is suitably protected by the outer grease holding lip 63 so as to prevent penetration of foreign particles, dust, water and the like thereat. Such outer and inner lip double seal leakproof bearing, being a sealed bearing, does not require lubrication. This outer and inner lip double seal arrangement of course is provided at each axial end of the bearing structure of the double seal bearing 42 for low noise, minimum vibration operation.

Preferably, a sealing gasket 70 of rubber, plastic or the like may be snugly or tightly disposed in journal opening 41, e.g. under inward extension 40*a*, and over the top axial end of the bearing 42 for added protection against leakage thereat. In fact, during rotation of shaft 38, such gasket 70 in conjunction with the ring or well formed by inward extension 40*a* and journal opening 41 may provide a slinging action preventing liquid in pump housing 33 from contacting the bearing seal at outer gap 63, e.g. by creating a suction at the bearing face tending to keep the seal face thereat dry.

As indicated in FIG. 2, the removable vacuum extraction recovery tank 14 is desirably provided as a substantially airtight tank with a, preferably central, tank flow opening 71 in its underside and an internal hollow, e.g. cylindrical, riser tube 72 positioned in the tank and having an entrance 73 at the end portion thereof disposed in the tank. The riser tube 72 is arranged for flow communicating the interior of the tank via the entrance 73 with the flow opening 71.

Tank 14 is conveniently provided as a two piece tank including a tank base 74*a* having a separate removable dome or cover 74*b* at its upper open end. Dome 74*b* suitably contains the tank inlet means or return snap coupler 24 mounted operatively thereon as well as an operatively opposed internal deflector means, e.g. in the form of a downwardly extending, directing wall or baffle 75 of preferably arcuate configuration, whereas base 74*a* contains tank flow opening 71 and riser tube 72.

Baffle 75 conveniently serves to deflect dry and wet ingredients, e.g. dirt, soil, cleaning liquid, residues, etc., delivered through the return coupler 24 into the interior or tank 14 thereat, so that such ingredients are directed away from the immediate vicinity of the riser tube entrance 73. This minimizes or substantially prevents flow of such ingredients through the riser tube 72 and out of the tank flow opening 71.

Dome 74*b* is suitably provided with an outwardly confining and downwardly facing annular skirt-like shoulder 76 having a sealing gasket 77, e.g. of rubber or plastic, thereon for sealingly engaging the upper open rim 78 of tank base 74*a* against air seepage thereat. To reinforce the arrangement, the dome 74*b* may also contain a cross bracket 79 having a central open seating portion 80 for downwardly and radially loosely slidably engaging the riser tube 72 in the vicinity of the entrance 73 thereof.

Hence, dome 74*b* and tank base 74*a* with their related conjoint parts constitute a removable tank assembly or tank 14 which may be inserted into opening 13 partially downwardly into container 2 and be coupled with the external vacuum hose 25 via return coupler 24.

Preferably, base 74*a* of tank 14 is constructed of non-conductive material such as plastic for preserving the desired electrical insulation of the entirety of the system. For the same reason, riser tube 72, cross bracket 79 and dome 74*b* thereof preferably will similarly be made of non-conductive material such as plastic as well. Of course, even where tank 14 is formed of metal, the necessary electrical insulation will be preserved inasmuch as tank 14 is protectively separated by the inherent spatially remote location and by the surrounding non-conductive internal framework 27 from any electrically conductive parts in the overall apparatus.

Dome 74*b* may be more especially formed of transparent plastic material to enable the user to see the return of extracted ingredients and the level of the accumulating contents in tank base 74*a*.

Vacuum creating means 81 are arranged suitably on internal framework 27 immediately below the underside of tank 14 in opening 13, including vacuum suction pump 82 and vacuum motor 83. Vacuum pump 82 may suitably include pump housing 84 mounted on framework 27 by any convenient means such as screws, brackets or the like (not shown) and flow connected via a central opening 84*a* in such pump housing 84 with tank flow opening 71 thereabove.

For this purpose, a mat type pliable annular sealing gasket 85, e.g. of rubber or plastic, having an interior annulus opening 86, may be advantageously disposed on the upper surface of the adjacent peripheral horizontal portion of framework 27 situated below opening 13 and the upper surface portion of pump housing 84 radially inwardly thereof and in surrounding and sealing flow relation to the central opening 84*a* in pump housing 84 thereat.

Hence, upon insertion of tank 14 partially into opening 13, the tank underside rests downwardly against gasket 85 and is upwardly supported on such peripheral or surrounding framework 27, thereby forming an annular seal against air seepage thereat between tank flow opening 71 and the central opening 84*a* in the pump housing 84, similar to the function of gasket 77 on the underside of the shoulder 76 of dome 74*b*.

Vacuum pump housing 84 contains fluid pumping means adapted to be driven by the shaft of vacuum motor 83. Such fluid pumping means may be in the form of an air suction impeller 87 operatively connected to the shaft 83*a* of vacuum motor 83 therebelow for causing a suction of vacuum flow condition to occur for drawing dry or wet ingredients entrained in ambient air, via tool 26, hoses 25*a* and 25 and return coupler 24 into the interior of tank 14 and along a downward path controlled by baffle 75, with the ingredients being deposited in the tank and the air separated therefrom thence passing into entrance 73 and through riser tube 72.

Such separated, relatively solid and moisture particle-free air then flows downwardly through tank flow opening 71, the interior opening 86 in gasket 85, the central opening 84*a* in pump housing 84 and into the pump 82. There, pump impeller 87 forces such air through exhaust outlet 88 operatively flow connected to pump housing 84 and having its exit disposed in a suitable hidden opening 89 in the bottom wall portion of container 2 thereat.

It will be realized that suction impeller 87 causes a vacuum condition to exist throughout the various parts and flow paths described above from tool 26 to exhauxt outlet 88, and because of the pressure differential therein relative to the ambient air external to the container 2, dome 74*b* will be pressed in substantially air tight relation against shoulder gasket 77 and upper rim 78 of base 74*a* and tank 14 will be pressed in substantially air tight relation against mat type gasket 85, thereby providing a sufficiently effective lock or seal against air seepage into the vacuum flow path thereat during operation of the vacuum creating means 81, i.e. without the need for extraneous positive clamp type means to achieve such air tight sealing interconnection of the parts in question.

On the other hand, when the vacuum creating means 81 is not in operation, the dome 74*b* may be simply lifted off of the upper rim 78 of base 74*a* and/or the tank 14 may be suitably lifted out of opening 13 in container 2, e.g. for emptying. Nevertheless, due to the construction of the dome shoulder 76 relative to tank upper rim 78, and of the tank 14 relative to opening 13 and peripheral interior framework 27 therebelow, the dome 74*b* and base 74*a* will remain in static stable disposition in place, relative to each other and to container 2, under normal conditions.

By the preferred presence of seating portion 80 on cross bracket 79 carried on the lower portion of dome 74*b*, dome 74*b* will be snugly disposed on base 74*a* not only via confining shoulder 76 but also via the generally embracing relation between seating portion 80 and the riser tube 72 in the vicinity of the entrance 73 at the upper open end thereof.

Vacuum motor 83 may be suitably mounted on the underside of vacuum pump housing 84 with its shaft 83*a* operatively connected to impeller 87 for driving the latter in the conventional manner. For this purpose, suitable electrical insulation may be provided between such motor and housing. Preferably, at least the lower portion 90 of vacuum pump housing 84 is provided of non-conductive material such as structural plastic and vacuum motor 83 is connected thereto by suitable means and downwardly depends therefrom. In the same way, exhaust outlet 88 is preferably also provided of non-conductive material such as structural plastic.

Hence, vacuum motor 83 is effectively maintained in electrically isolating non-conductive relation to vacuum pump 82 via electrical insulation or non-conductive lower portion 89 of pump housing 84, and in turn tank 14, especially in view of the intervening disposition of mat type gasket 85 and the peripheral disposition of framework 27 therebelow. Due to the spatial remoteness of the vacuum recovery system from the liquid dispensing system, the vacuum creating means 81 and the tank 14 are safely arranged not only in electrically isolating non-conductive relation to each other but also in such relation to the delivery motor 43, delivery pump 32, reservoir 12 and other related parts thereat.

Vacuum motor 83 is also preferably provided in the form of an induction type open coil motor. In fact, the vacuum pump 82 and vacuum motor 83 may be fashioned as like or similar parts to liquid delivery pump 32 and induction delivery motor 43 (see FIG. 3), appropriately dimensioned and constructed for pumping air through the vacuum recovery system of the apparatus as opposed to pumping cleaning liquid through the pressure dispensing system thereof, and also contemplating the same type various electrically isolating elements and bearing elements, especially such a double seal bearing arrangement for journaling the shaft 83*a* of vacuum motor 83, corresponding to the shaft 38 of the delivery motor 43, through vacuum pump housing 84 for operative connection with impeller 87.

However, since the vacuum creating means 81 will not normally encounter any liquid, due to the nature of the inherent collection trap provided by the positioning of riser tube 72 in tank 14 and the added effect of directional flow control of baffle 75 relative to incoming liquid particles in the vacuum suction air stream from tool 26 to return coupler 24, such extensive constructional precautions are not absolutely necessary.

Of course, the vacuum creating means 81 and tank 14 may alternatively be used for dry vacuuming purposes as well in the conventional manner, as the artisan will appreciate.

The power and return line circuit conduit means for energizing delivery motor 43 and vacuum motor 83 include cord 15 suitably electrically isolatedly mounted in container 2. Cord 15 extends internally through container 2 to switches 18 and 19 on external panel 17 and thence via parallel sub-circuit 15*a* controlled by switch 18 to the field coils of delivery motor 43 and via parallel sub-circuit 15*b* controlled by switch 19 to the appropriate field coils (not shown) of vacuum motor 83. Hence, motors 43 and 83 are suitably connected in parallel in the overall circuit in conventional manner for selective separate operation, each alone, or simultaneous operation together, by appropriate selection of on-off switches 18 and 19, as the case may be.

Of course, the entirety of the extend of cord 15 and sub-circuits 15*a* and 15*b* will desirably be suitably electrically insulated, e.g. by conventional rubber and/or plastic tubular coverings or the like, thereby also insuring electrical isolation from any attendant conductive liquid which might otherwise short circuit the electrical conduit means, just as the field coils and remaining electrical components of the motors are electrically isolated from the other parts of the apparatus.

Appropriate fuses or automatically resettable thermal protectors or circuit breakers (not shown) may be suitably provided in sub-circuits 15*a* and 15*b* respectively of the circuit conduit means in conventional manner, e.g. at the field coils of the motors, for added efficiency, prolonged operating life and safety, as the artisan will appreciate.

Where optional heating means 12*a* are provided in conventional manner at reservoir 12 for preheating the cleaning liquid, the corresponding control switch (not shown) therefor and appropriate fuse or thermal protector or circuit breaker (not shown) will be situated in a further parallel sub-circuit 15*c* (FIG. 2) therewith in the power and return line circuit conduit means, just as in the case of sub-circuits 15*a* and 15*b*, as the artisan will appreciate.

Optionally, the riser tube 72 may be advantageously provided at its entrance 73 with a porous lint filter element 91, e.g. in the form of a tube or cylinder closed off at its upper end and inserted via its open lower end snugly over the upper end of the riser tube and resting on seating portion 80. Such filter element 91 will similarly enhance the prevention of various dry and wet ingredients in the incoming air flow from tool 26 from entering the entrance 73 of the riser tube and from reaching the vacuum creating means 81.

It will be seen that the disposition of the various portions of the non-conductive interior framework 27 in container 2, appropriately physically separates all adjacent portions of the liquid dispensing system from the vacuum extraction system, and that the spatial remoteness of the remainder of such two systems similarly insures their separation from each other. Moreover, the electrically insulating nature of the mounting of delivery motor 43 and its electrically conductive parts relative to liquid pump 32 and reservoir 12 and of vacuum motor 83 and its electrically conductive parts relative to vacuum pump 82 and tank 14, likewise insures the separation of these conjoint components from each other.

Such arrangement of parts accordingly provides a second internal electrically insulating barrier in addition to the first external electrically insulating barrier constituted by non-conductive container 2 per se, between all live electrical conductors present and a potential ground, for double insulated, electrically energized operation of either or both of motors 43 and 83 therein, and/or of the optional protectively insulated electrical heating means 12*a*, without the need for a separate ground line connection, yet with the corresponding motor, and/or heating means, in each case completely electrically isolated from all other parts in a sufficiently safe manner to avoid accidental shock to the user, despite the presence of liquid in the apparatus.

Such liquid handling apparatus, especially where electrical heating means 12*a* are conventionally included for preheating the cleaning liquid in reservoir 12 or preheated or hot cleaning liquid is poured into reservoir 12 before closing cover 6, constitutes a jet hot water extractor safely usable with a normal two pronged electrical plug without a separate ground line for dry or wet vacuum extraction of floor surfaces or the like.

Such construction is low in cost and easy to assembly, especially regarding the preformed container 2, the built-in reservoir 12, the delivery pump 32 and motor 43 assembly as well as the vacuum pump 82 and motor 83 assembly, together with the appropriate related parts including the double seal bearing or bearings 42.

By the advantageous use of an induction motor or cognate motor with open coil construction as the drive means for the liquid delivery pump, especially with the cooling fan incorporated on the lower end of the motor shaft thereof, cooling air will be continuously available and/or supplied to the electrical windings of the motor, the shaft as well as the pump parts, permitting prolonged trouble free operation even when the pump is dry or is run for an extended period without any liquid being pumped thereby as when the liquid reservoir supply is temporarily used up and has not yet been replenished.

By inclusion of a thermal protector such as a replaceable fuse or an automatically resettable thermal protector or circuit breaker or the like (not shown) in conventional manner such as in the arrangement of the field coils or stator windings and/or in the optional heating means 12*a*, e.g. set at a threshold temperature slightly higher than the predetermined rated or allowable running temperatures of the electrical windings of the motor or resistance element of the heating means involved so as to accommodate temporary power surges in the usual way, added protection may be provided against fire or burning resulting from overcurrent or over temperature conditions.

Thus, the presence of the fan on the rear or lower end portion of the motor shaft as an integral part of the liquid delivery system will normally be sufficient to cool the motor and pump adequately under the various circumstances of service use, including the dry running of the liquid delivery pump, whereby to minimize the occurrence of pump leaks and motor failure from overheating. With the particular incorporation of a thermal protector as well in the liquid delivery system electrical field coil circuitry, should the fan fail or fail to provide adequate cooling, the pump and motor would still be protected from adverse effect by the supplemental inclusion of such thermal protector.

The use of the contemplated double sealed ball bearings, i.e. a ball bearing construction which incorporates a double seal or double lip providing two seals, comprising an outer seal and an inner seal, or a seal within a seal, at each axial end of the bearing, permanently lubricated and leakproof in nature, contributes to the permitted easy assembly of the various parts and aids in the achievement of the desired safe double insulated condition of the assembly. This is true since the double seal bearing may be readily press fitted both to the non-conductive or plastic lower portion of the pump housing at the journal opening therein and to the motor shaft. As part of the pump assembly located in the journal opening of the pump housing, its inclusion eliminates the need for a separate front or upper bearing bracket for the front or upper end portion of the motor shaft.

More significantly, the double seal bearing contributes to the capability of the pump and motor assembly to run dry or without pumping any cleaning liquid. Also, where the non-conductive sleeve on the motor shaft extends under the double seal bearing as press fitted between the pump housing plastic lower portion and such shaft, even such bearing will be effectively isolated electrically from any conductive medium or part of the apparatus except possibly the cleaning liquid itself.

It will be immediately realized in this regard that the capability of a delivery pump and motor system to run dry or without pumping any liquid is a very important feature in dealing with the consuming public, aside from the basic feature of double insulation and the operation of the assembly without a separate ground line connection. Either as a rental unit or a domestic model, the suitably small and compact apparatus of the invention containing the above noted safeguards will enjoy rugged performance, even under relatively severe abuse. The open coil construction of the motor, the fan, the double seal ball bearing and even the thermal protector where present will conjointly serve to improve the life of the delivery pump and motor as well as increase the reliability of the various operating parts thereof.

Advantageously, the delivery pump and motor may be built as a sub assembly and because of its overall double insulated design, such sub assembly can utilize a standard or conventional open coil motor suitably electrically pre-isolated from the remaining parts thereof. Hence, the sub assembly may be provided for ready incorporation as a unit into the container at minimum overall production and assembly cost. The corresponding motor shaft in such case suitably will be pre-isolated electrically from the remainder of the motor parts, so that even if water or other medium in the liquid reservoir were perchance to become electrically conductive with live current, there would still be no electrical path of conductivity between such medium and the motor or any external part of the apparatus, or via any such liquid to or through the motor or any external part of the apparatus.

Indeed, under all contemplated conditions of use, all of the electrically conductive and electrically operated motive and other parts, e.g. motors 43 and 83 and heating means 12*a*, will remain completely isolated electrically from the remainder of the parts of the apparatus and will continue to be internally disposed in structurally and spatially remote protective static stable disposition in the apparatus.

It will be appreciated that the foregoing specification and accompanying drawings are set forth by way of illustration and not limitation, and that various modifications and changes may be made therein without departing from the spirit and scope of the present invention which is to be limited solely by the scope of the appended claims.

What is claimed is:

1. Double insulated, electrically energized liquid handling apparatus, usable without a separate ground line connection, comprising an exteriorly and interiorly electrically isolated electrical system including an exteriorly electrically insulating container, thereby providing a first insulating barrier, protectively containing completely therewithin a reservoir, a pump for pumping liquid from the reservoir and a motor for driving the pump, and means for maintaining the motor in interiorly electrically isolating non-conductive relation to the reservoir and pump, thereby providing a second insulating barrier, and electrically insulated means for energizing the motor with a source of current without a separate ground line for double insulated operation of the motor in the container.

2. Double insulated, electrically energized liquid handling apparatus, usable without a separate ground line connection, and having an exteriorly and interiorly electrically isolated electrical system comprising an exteriorly electrically insulating container, thereby providing a first insulating barrier, the container protectively containing completely therewithin a liquid reservoir flow connected to a delivery pump adapted for flow connection in turn with an external applicator for pumping liquid from the reservoir thereto, an electrically isolated delivery motor including a rotatably mounted shaft operatively connected for driving the pump, and means for maintaining the motor in electrically isolating non-conductive operative relation to the shaft for rotation of the shaft and in electrically isolating non-conductive relation to the reservoir and pump, thereby providing a second insulating barrier, and electrically insulated conductive power and return line circuit conduit means for energizing the motor with a source of current without a separate ground line, for double insulated operation of the motor in the container for driving the pump by the shaft.

3. Apparatus according to claim 2 wherein the shaft is operatively connected to the pump through a substantially leakproof double seal bearing for journaling the shaft to the pump in substantially leakproof double seal condition.

4. Apparatus according to claim 2 wherein a substantially airtight vacuum extraction recovery tank is provided on the container having a tank inlet means adapted for flow connection with an external vacuum hose, a tank flow opening and an internal riser tube positioned in the tank and arranged for flow communicating the interior of the tank with the tank flow opening, means for creating a vacuum are positioned in the container in flow connection with the tank flow opening, and the tank and means for creating a vacuum are arranged in electrically isolating non-conductive relation to the delivery motor.

5. Apparatus according to claim 4 wherein the means for creating a vacuum include a vacuum pump and an electrically energized vacuum motor in the container, further means are provided for maintaining the vacuum pump in electrically isolating non-conductive relation to the delivery motor and for maintaining the vacuum motor in electrically isolating non-conductive relation to the reservoir, delivery pump, shaft, delivery motor, tank and vacuum pump, and the power and return line circuit conduit means are arranged for selectively electrically energizing the vacuum motor without a separate ground line.

6. Double insulated, electrically energized liquid handling apparatus, usable without a separate ground line connection, and having an exteriorly and interiorly electrically isolated electrical system comprising an exteriorly electrically insulating container of non-conductive material, thereby providing a first insulating barrier, a cleaning liquid dispensing reservoir protectively contained completely within the container, a liquid delivery pump protectively contained completely within the container including a pump housing having an intake portion flow connected to the reservoir and a delivery portion adapted for flow connection in turn with an external applicator for applying dispensed cleaning liquid to a surface to be cleaned, and liquid pumping means operatively mounted in the pump housing and adapted to be driven by a rotatable shaft for pumping cleaning liquid from the intake portion to the delivery portion of the pump housing, an electrically isolated delivery induction motor protectively contained completely within the container including a rotatably mounted shaft operatively connected for driving the pumping means, electrically insulating rotor mounting means of non-conductive material, an induction armature rotor operatively mounted by the rotor mounting means on the shaft for rotation with the shaft and arranged thereon in electrically isolating non-conductive relation with respect thereto, electrically insulating stator mounting means of non-conductive material, and an electrically energizable field coil stator radially spaced from the shaft and rotor and stationarily mounted by the stator mounting means in the container for induction rotation of the rotor and arranged thereat in electrically isolating non-conductive relation to the shaft, thereby providing a second insulating barrier, and electrically insulated conductive power and return line circuit conduit means for energizing the delivery motor with a source of current without a separate ground line, for double insulated operation of the motor in the container for driving the pumping means by the shaft.

7. Apparatus according to claim 6 wherein the container is composed of plastic, the rotor mounting means is in the form of a sleeve of non-conductive material operatively interposed between and interconnecting the shaft and rotor for common rotation, and the stator mounting means is located on the pump housing.

8. Apparatus according to claim 7 wherein the pump housing includes a wall portion of non-conductive material and the stator mounting means is formed on such pump wall portion.

9. Apparatus according to claim 6 wherein the pump housing includes a wall portion having a journal opening therein provided with a substantially leakproof double seal bearing, and one end of the shaft extends through the opening for operative connection with the pumping means and is journaled in the bearing in substantially leakproof double seal condition thereat and in electrically isolating non-conductive relation with respect to the stator and rotor.

10. Apparatus according to claim 9 wherein the other end of the shaft carries a fan for directing ambient air into flushing contact with the delivery motor to cool the stator and rotor during operation thereof.

11. Apparatus according to claim 10 wherein the other end of the shaft is remotely journaled in a further bearing in the container arranged in electrically isolating non-conductive relation with respect to the stator and rotor.

12. Apparatus according to claim 11 wherein an electrically non-conductive protective cage is provided in covering relation over the other end of the shaft and the fan.

13. Apparatus according to claim 9 wherein the pump wall portion is composed of non-conductive material and the stator is stationarily mounted thereon in electrically isolating non-conductive relation to the shaft.

14. Apparatus according to claim 13 wherein remote journal mounting means of non-conductive material are attached to the stator, the other end of the shaft carries a fan for directing ambient air into flushing contact with the delivery motor to cool the stator and rotor during operation thereof, and the other end of the shaft is remotely journaled in a further bearing mounted in the remote journal mounting means and arranged in electrically isolating non-conductive relation with respect to the stator and rotor.

15. Apparatus according to claim 14 wherein an electrically non-conductive protective cage is provided in covering relation over the other end of the shaft and the fan and attached to the remote journal mounting means.

16. Apparatus according to claim 9 wherein the shaft extends substantially vertically downwardly from the journal opening and the double seal bearing is disposed in the journal opening in substantially liquid tight leakproof friction fit stationery relation therewith for maintaining the shaft in axially stationary and rotatably mounted suspended relation with respect to the pump wall portion.

17. Apparatus according to claim 16 wherein the pump is directly connected to the reservoir and arranged in substantially downwardly suspended relation thereto, a sleeve of non-conductive material is operatively interposed between the shaft and rotor for interconnecting the shaft and rotor for common rotation and for mounting the rotor on the shaft in electrically isolating non-conductive relation with respect thereto, the pump wall portion is composed of non-conductive material and the stator is stationarily mounted thereon in substantially downwardly suspended relation thereto and in electrically isolating non-conductive relation to the shaft.

18. Apparatus according to claim 17 wherein remote journal mounting means of non-conductive material are attached to the stator in substantially downwardly suspended relation thereto, the other end of the shaft carries a fan for directing ambient air into upwardly flushing contact with the delivery motor to cool the stator and rotor during operation thereof and the other end of the shaft is remotely journaled in a further bearing mounted in the remote journal mounting means and arranged in electrically isolating non-conductive relation with respect to the stator and rotor.

19. Apparatus according to claim 18 wherein commutator means are operatively mounted by electrically insulating commutator mounting means of non-conductive material on the shaft for common rotation with the shaft in electrical connection with the armature rotor and in electrically isolating non-conductive relation to the shaft, and brush means are operatively mounted on the remote journal mounting means adjacent to the stator and arranged thereat in electrical connection with the stator and in electrically isolating non-conductive relation to the shaft for electrically conductive coacting sliding contact with the commutator means, and wherein an electrically non-conductive protective cage is provided in covering relation over the other end of the shaft and the fan and attached to the reemote journal mounting means.

20. Apparatus according to claim 6 wherein a substantially air tight vacuum extraction recovery tank is provided on the container having a tank inlet means adapted for flow connection with an external vacuum hose, a tank flow opening adapted for flow connection with means for creating a vacuum, and an internal riser tube positioned in the tank and arranged for flow communicating the interior of the tank with the tank flow opening, and the tank is arranged in electrically isolating non-conductive relation to the delivery motor.

21. Apparatus according to claim 20 wherein means for creating a vacuum are positioned in flow connection with the tank flow opening.

22. Apparatus according to claim 21 wherein the means for creating a vacuum include a vacuum pump and an electrically energized vacuum motor in the container, the vacuum pump is arranged thereat in electrically isolating non-conductive relation to the delivery motor, further electrically insulating means of non-conductive material are provided for maintaining the vacuum motor in electrically isolating non-conductive relation to the reservoir, delivery pump, shaft, rotor and stator of the delivery motor, vacuum tank and vacuum pump, and the power and return line circuit conduit means are arranged for selectively electrically energizing the vacuum motor without a separate ground line.

23. Apparatus according to claim 22 wherein selective switch means are provided in the power and return line circuit conduit means for selectively energizing the delivery motor alone, the vacuum motor alone, and both motors together.

24. Apparatus according to claim 23 wherein the vacuum motor is a further induction motor.

25. Apparatus according to claim 23 wherein the vacuum pump includes fluid pumping means adapted to be driven by a rotatably further shaft, and the vacuum motor is a further induction motor corresponding to that for driving the delivery pump and having a further shaft operatively connected for driving the fluid pumping means.

26. Apparatus according to claim 20 wherein the tank is removably positioned on the container for receiving dry as well as wet ingredients delivered through the tank inlet means and the tank riser tube is provided with a porous filter element to prevent various dry and wet ingredients delivered into the tank from flowing through the riser tube and out the tank flow opening.

27. Apparatus according to claim 20 wherein the tank is removably positioned on the container for receiving dry as well as wet ingredients delivered through the tank inlet means, the riser tube has an entrance at the riser end portion thereof disposed in the tank, and a deflector means is provided in the interior of the tank to deflect dry and wet ingredients delivered through the tank inlet means into the tank away from the immediate vicinity of the riser tube entrance to prevent flow thereof through the riser tube and out the tank flow opening.

28. Double insulated, electrically energized cleaning liquid handling apparatus, usable without a separate ground line connection, comprising a transportable electrically insulating structural plastic container including an outer confining and enclosing non-conductive wall surface provided with a reservoir access opening in the upper portion thereof and an openable electrically insulating plastic closure means for closing the access opening and in turn forming a portion of the outer non-conductive wall surface thereat, the container thereby providing a first exterior insulating barrier, roller means for transporting the container along a surface to be cleaned, a cleaning liquid dispensing reservoir protectively disposed completely within the container at the access opening and having an open upper portion communicating with the exterior of the container through the access opening and normally closed off from the exterior by the closure means and further having a closed lower portion provided with a dispensing exit, a liquid delivery pump protectively disposed completely within the container below the reservoir and including a pump housing having an intake portion flow connected to the reservoir exit and a delivery portion flow connected to a liquid delivery flow conduit provided with an outwardly terminating electrically insulating connection portion of non-conductive material extending to the container outer wall surface and adapted for flow connection thereat with an external applicator for selectively applying dispensed cleaning liquid to the surface to be cleaned, at least the lowermost portion of the pump housing being formed of electrically insulating structural plastic and including a non-conductive wall portion having a journal opening therein provided with a substantially leakproof double seal bearing, and liquid pumping means operatively mounted in the pump housing and adapted to be driven by a substantially vertical rotatable shaft for pumping cleaning liquid from the intake portion to the delivery portion of the pump housing and in turn through the delivery flow conduit, an electrically isolated delivery induction motor protectively disposed completely within the container below the pump and including a downwardly extending substantially vertical rotatably mounted shaft having its upper end extending upwardly through the journal opening and journaled in the double seal bearing in substantially leakproof condition thereat and operatively connected for driving the pump means, an induction armature rotor mounted on the shaft and provided with an electrically insulating rotor mounting sleeve of non-conductive material operatively interposed between and interconnecting the rotor and shaft for common rotation and arranged for maintaining the rotor in electrically isolating non-conductive relation to the shaft, and an electrically energizable field coil stator radially spaced from the journal opening, double seal bearing, shaft and rotor and stationarily mounted on the pump housing non-conductive wall portion adjacent thereto for induction rotation of the rotor and arranged thereat in electrically isolating non-conductive relation with respect to the reservoir, interior of the pump housing, pumping means, journal opening, double seal bearing and shaft, the non-conductive pump housing wall portion and sleeve together with the radially spaced disposition of the stator with respect to the shaft thereby providing a second interior insulating barrier, and electrically insulated conductive power and return line circuit conduit means for energizing the delivery motor with a source of common household current without a separate ground line, for double insulated operation of the motor within the container for driving the pumping means by the shaft.

29. Apparatus according to claim 28 wherein the container outer wall surface is provided with a tank insertion opening in the upper portion thereof, a substantially air tight vacuum extraction recovery tank is removably inserted at least partially into the tank insertion opening, the tank is provided with a tank inlet means adapted for flow connection with an external vacuum hose, a tank flow opening and an internal riser tube positioned in the tank and arranged for flow communicating the interior of the tank with the tank flow opening, means for creating a vacuum are positioned in flow connection with the tank flow opening, and the tank and means for creating a vacuum are arranged in electrically isolating non-conductive relation to the reservoir, delivery pump, shaft, rotor and stator of the delivery motor.

30. Apparatus according to claim 29 wherein the double seal bearing is disposed in the journal opening in substantially liquid tight leakproof friction fit stationary relation therewith for maintaining the shaft in axially stationary and rotatably mounted suspended relation with respect to the pump wall portion, and the stator in stationarily mounted on the pump wall portion in substantially downwardly suspended relation thereto.

31. Apparatus according to claim 29 wherein remote journal mounting means of non-conductive material are attached to the stator in substantially downardly suspended relation thereto, the lower end of the shaft carries a fan for directing ambient air into flushing contact with the delivery motor to cool the stator and rotor during operation thereof, the lower end of the shaft is remotely journaled in a further bearing mounted in the remote journal mounting means and arranged in electrically isolating non-conductive relation with respect to the stator and rotor, an electrically non-conductive protective cage is provided in covering relation over the lower end of the shaft and the fan and attached to the remote journal mounting means, and an ambient air flow opening is provided in the lower portion of the container in the vicinity of the cage for enhanced exchange of ambient air between the exterior of the container and the interior portion thereof adjacent the cage and fan.

* * * * *